US005727869A

United States Patent [19]

Crosby et al.

[11] Patent Number: 5,727,869

[45] Date of Patent: Mar. 17, 1998

[54] FLUORESCENT LIGHT FIXTURE WITH BREAKAWAY SOCKET

[75] Inventors: Doyle Crosby, Richmond; Dale A. Petersen, Fremont, both of Calif.

[73] Assignee: Boyd Lighting Company, San Francisco, Calif.

[21] Appl. No.: 663,000

[22] Filed: Jun. 17, 1996

[51] Int. Cl.[6] ..... F21S 3/00

[52] U.S. Cl. ..... 362/217; 362/223; 362/226; 439/234; 439/242

[58] Field of Search ..... 439/226, 233, 439/234, 237, 242, 243, 244; 313/318.02; 362/217, 220, 221–223, 225, 226

[56] References Cited

U.S. PATENT DOCUMENTS

| | | | |
|---|---|---|---|
| 2,306,908 | 12/1942 | Stiffel | 362/220 |
| 2,368,879 | 2/1945 | Reeves | 439/237 |
| 2,569,143 | 9/1951 | Bennett | 362/220 |
| 2,656,521 | 10/1953 | Barre, Jr. | 439/244 |
| 3,252,125 | 5/1966 | Moss | 439/237 |
| 3,426,312 | 2/1969 | Fitz Gerald | 439/244 |
| 4,435,744 | 3/1984 | Russo | 362/225 |
| 5,381,321 | 1/1995 | Fearing, Jr. et al. | 439/242 |

OTHER PUBLICATIONS

Front and back sides of "Baton" incandescent wall lamp brochure by Boyd Lighting Company. 1992.

*Primary Examiner*—Alan Cariaso
*Attorney, Agent, or Firm*—Jack Lo

[57] ABSTRACT

A fluorescent light fixture includes an elongated housing for mounting on a wall or a ceiling. A fixed socket is attached to one end of the housing by a fixed connecting arm. A breakaway socket is movably attached to another end of the housing by a breakaway connecting arm. A tubular lens is secured between the sockets, and a fluorescent tube is centered within the tubular lens by a pair of centering rings. The fluorescent tube is completely surrounded by the tubular lens, which diffuses the light in a 360 degree circle. Electrical connectors arranged within the sockets are mated with corresponding terminals on the ends of the fluorescent tube. The breakaway socket is movable away from the housing for releasing the tubular lens and the fluorescent tube, so that the fluorescent tube may be removed and replaced in a limited space. The breakaway socket is movable against the housing for securing the tubular lens and fluorescent tube.

1 Claim, 3 Drawing Sheets

FLUORESCENT LIGHT FIXTURE WITH BREAKAWAY SOCKET

BACKGROUND OF THE INVENTION

1. Field of the Invention

This invention relates generally to light fixtures, specifically to a fluorescent light fixture with a breakaway socket.

2. Prior Art

A typical fluorescent light fixture includes a pair of orthogonal arms fixedly attached to opposite ends of an elongated housing. A socket is arranged on the end of each arm. A fluorescent tube is installed by positioning it between the arms, and sliding the terminals on each end of the tube into a slot on a corresponding socket. The fluorescent tube is locked in place by twisting it about its axis. A typical fluorescent light fixture also includes a lens, which may be a flat lens that covers a ceiling-mounted, recessed fixture, or a curved lens that wraps around a wall-mounted fixture. However, such fixture and lens arrangements block some of the light from the tube, and they may be inconvenient to disassemble and reassemble when replacing the tube.

OBJECTS OF THE INVENTION

Accordingly, an object of the present invention is to provide a fluorescent light fixture that completely surrounds a fluorescent tube in a tubular glass lens to diffuse the light in a 360 degree circle.

Another object of the present invention is to provide a fluorescent light fixture that includes a breakaway socket for enabling tube replacement in a limited space.

Still another object of the present invention is to provide a fluorescent light fixture that includes a centering device for centering the fluorescent tube in the tubular glass lens to enable easy tube replacement.

Further objects of the present invention will become apparent from a consideration of the drawings and ensuing description.

SUMMARY OF THE INVENTION

A fluorescent light fixture includes an elongated housing for mounting on a wall or a ceiling. A fixed socket is fixedly attached to one end of the housing, and a breakaway socket is slidably attached to the other end of the housing in alignment with the fixed socket. Electrical connectors are arranged in each socket. A tubular glass lens and a fluorescent tube are secured between the sockets. The fluorescent tube is centered within the tubular lens by a pair of centering rings. Moving the breakaway socket away from the housing releases the lens and the fluorescent tube, so that the fluorescent tube may be easily removed and replaced, particularly in a limited space. The tubular lens diffuses light from the fluorescent tube in a 360 degree circle.

DRAWING REFERENCE NUMERALS

| | |
|---|---|
| 10. Housing | 11. Fixed Socket |
| 12. Breakaway Socket | 13. Fixed Connecting Arm |
| 14. Breakaway Connecting Arm | 15. Tubular Lens |
| 16. Nut | 17. Tubular Side Wall |
| 18. Open Inner End | 19. Closed Outer End |
| 20. Gasket | 21. Disc |
| 22. Connectors | 23. Centering Ring |
| 24. Hole | 25. Domed Center Portion |
| 26. Fluorescent Tube | 27. Hole |
| 28. Threaded Stud | 29. Guide Tubes |
| 30. Channels | 31. Centering Ring |
| 32. Pin Terminals | |

DESCRIPTION—FIG. 1

Figure 1:
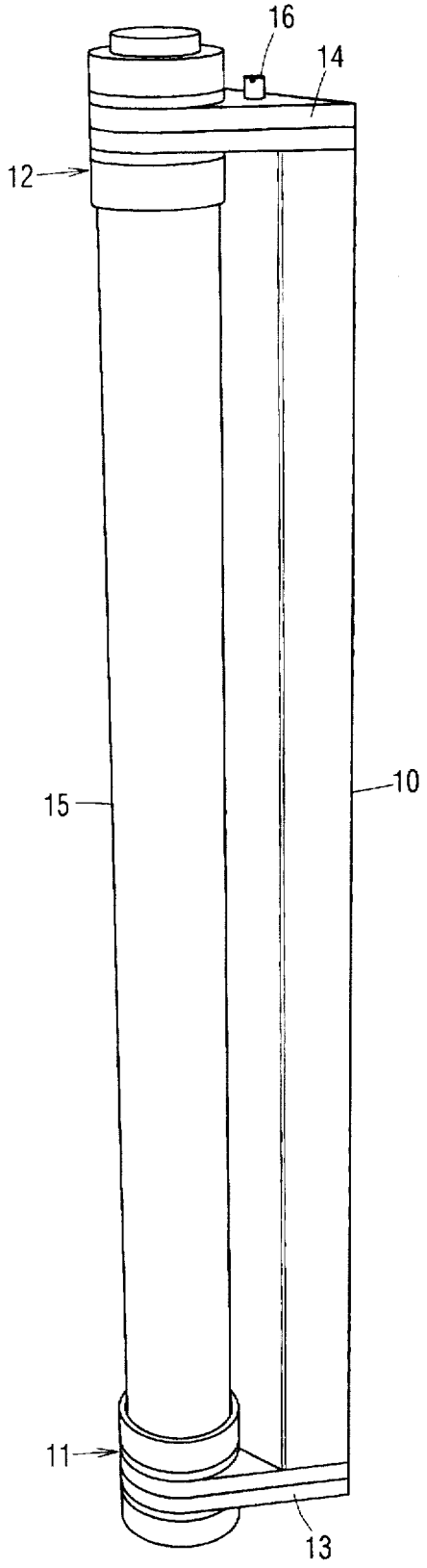
FIG. 1 is a side perspective view of a fluorescent light fixture with breakaway socket in accordance with a preferred embodiment of the invention.

In accordance with a preferred embodiment of the invention shown in the side perspective view of FIG. 1, a fluorescent light fixture includes a chromed, reflective housing 10, a fixed socket 11, and a breakaway socket 12 aligned with fixed socket 11. Fixed socket 11 is attached to a first end of housing 10 by a fixed connecting arm 13. Breakaway socket 12 is movably attached to a second end of housing 10 by a breakaway connecting arm 14. A tubular, translucent glass lens 15 is secured between sockets 11 and 12. Connecting arm 14 is removably secured to the second end of housing 10 by a nut 16.

ASSEMBLY—FIGS. 1-5

The assembly of the light fixture is shown in FIGS. 1–5. As shown in the exploded view in FIG. 2, fixed socket 11 includes a tubular side wall 17, an open inner end 18, and a closed outer end 19. An annular rubber gasket 20 is positioned against closed outer end 19. A disc 21 with a pair of electrical connectors 22 is arranged in the center of closed outer end 19. A centering ring 23, shown disassembled from socket 11, includes a hole 24 arranged on a domed center portion 25.

Figure 3:
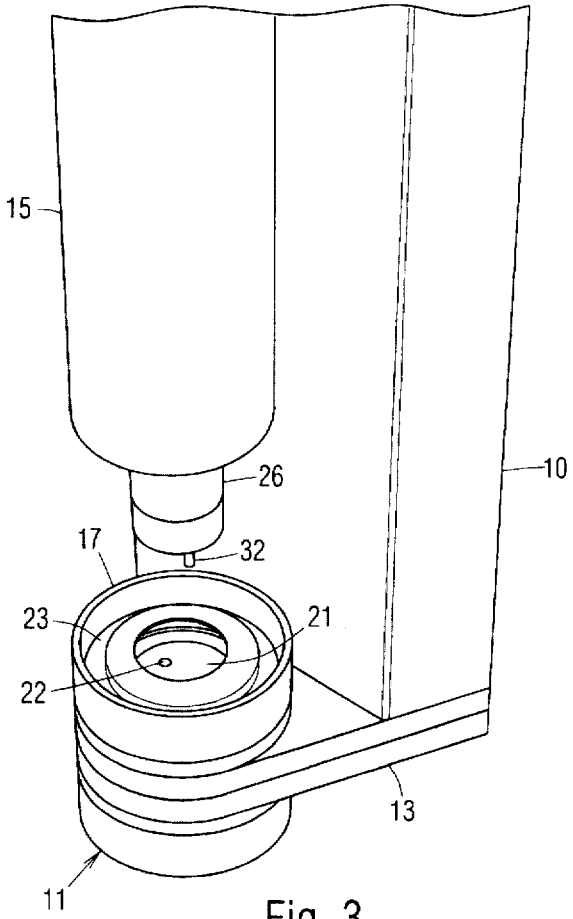
FIG. 3 is an exploded view of a fluorescent tube and a tubular lens being installed in the fixed socket of the light fixture.
Figure 4:
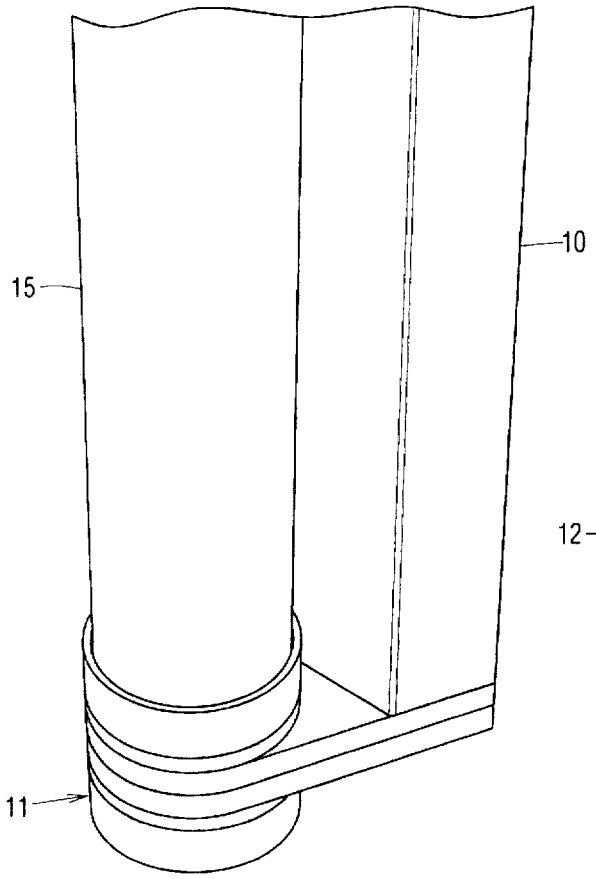
FIG. 4 a side perspective view of the light fixture after the tube and the lens are installed in the fixed socket.

As shown in FIG. 3, centering ring 23 is positioned within tubular side wall 17 of socket 11. A conventional fluorescent tube 26 with a pair of pin terminals 32 (one shown) is positioned within tubular lens 15. Fluorescent tube 26 is inserted through centering ring 23 until pin terminals 32 are securely mated with connectors 22. Tubular lens 15 is then fitted into socket 11, as shown in FIG. 4.

Figure 2:
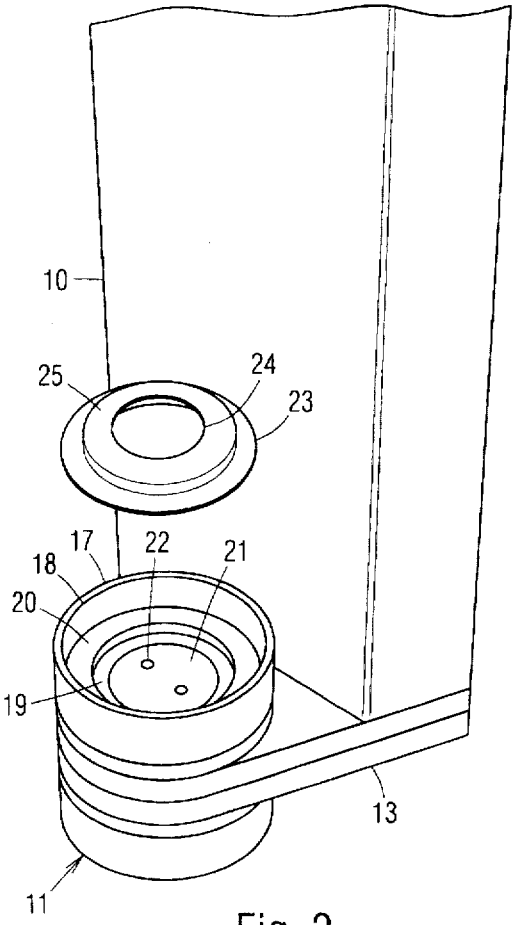
FIG. 2 is an exploded view of a centering ring being installed in a fixed socket of the light fixture.
Figure 5:
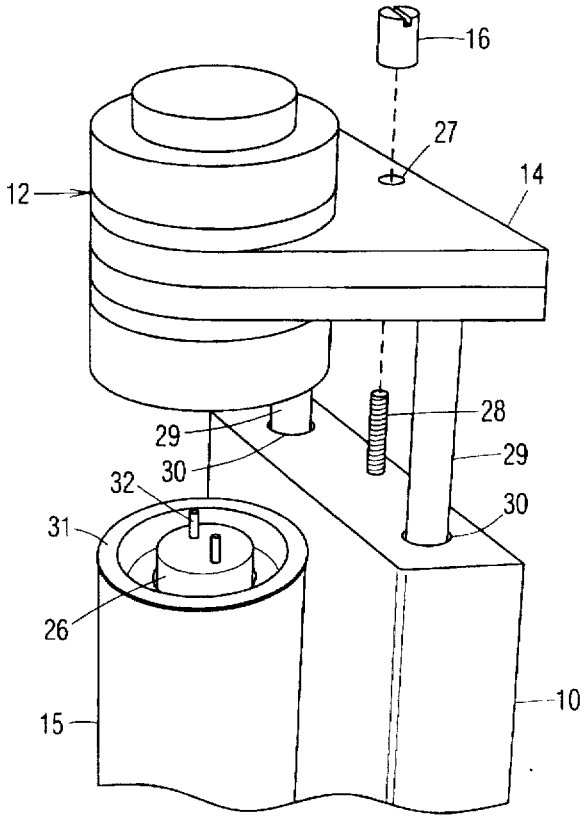
FIG. 5 is an exploded view of the tube and lens being installed in a breakaway socket of the light fixture.

As shown in FIG. 5, breakaway socket 12 is identical to fixed socket 11. Breakaway connecting arm 14 has a distal end fixedly attached to breakaway socket 12, and a proximal end with a hole 27 aligned with a threaded stud 28 fixedly extending from the end of housing 10. A pair of guide tubes 29 are fixedly attached to the inner side of connecting arm 14. Tubes 29 are slidably positioned within a pair of channels 30 on the end of housing 10. The top end of fluorescent tube 26 is centered within tubular lens 15 by another centering ring 31, which is identical to centering ring 23 (FIG. 2).

Breakaway socket 12 is moved inwardly until it is mated with fluorescent tube 26 and lens 15. Stud 28 is longer than the thickness of connecting arm 14, so that when connecting arm 14 is positioned against the end of housing 10, stud 28 extends out of hole 27. Nut 16 is threaded onto stud 28 to lock connecting arm 14 in position, as shown in FIG. 1. Centering ring 31 ensures that fluorescent tube 26 is centered within lens 15, so that pin terminals 32 will align and mate with the electrical connectors (not shown) in breakaway socket 12. Thus the light fixture may be disassembled and reassembled easily and in a limited space when replacing fluorescent tube 26.

Electrical connections (not shown) between fixed socket 11 and conventional drive circuitry (not shown) within housing 10 are routed through hollow connecting arm 13. Electrical connections (not shown) between breakaway socket 12 and the drive circuitry are routed through hollow breakaway connecting arm 14 and one of guide tubes 29.

In use, tubular glass lens 15 diffuses the light from fluorescent tube 26 in a 360 degree circle. The light emitted toward housing 10 is reflected by the chromed surface thereof, so that all of the light is directed toward a work area or living space.

SUMMARY, SUBSTITUTES, AND SCOPE

Accordingly, we have provided a fluorescent light fixture which completely surrounds a fluorescent tube with a tubular glass lens to maximize the transmission of light. It includes a breakaway socket that enables tube replacement in a limited space. It also includes a centering device for centering the tube in the lens, so as to ensure that the tube will mate with the connectors in the sockets.

Although the above descriptions are specific, they should not be considered as limitations on the scope of the invention, but only as examples of the embodiments. Many substitutes and variations are possible within the teachings of the invention. For example, the housing may have a different surface finish. Other types of connectors may be provided for mating with fluorescent tubes with other types of terminals. The lens may be made of acrylic, or any other suitable material. The lens may be made smaller to fit closely around the fluorescent tube, so that the centering rings may be eliminated. The tubular lens may have a polygonal cross-section. Instead of centering rings, the lens may incorporate longitudinal internal fins for centering the fluorescent tube. The breakaway socket may be slidably attached to the housing in other ways, e.g., the housing may be lengthened, and the socket may be slidable along a slot on the front side of the housing. The pair of round tubes for connecting the breakaway connecting arm to the housing may be replaced with a single square tube positioned in a square hole on the housing. Therefore, the scope of the invention should be determined by the appended claims and their legal equivalents, not by the examples given.

We claim:

1. A fluorescent light fixture, comprising:

an elongated housing having first and second ends;

a fixed socket adapted to be connected to a first end of a fluorescent tube;

a breakaway socket adapted to be connected to a second end of said fluorescent tube;

a fixed connecting arm fixedly connecting said fixed socket to said first end of said housing;

a breakaway connecting arm fixedly attached to said breakaway socket, said breakaway connecting arm being orthogonal to said housing, said breakaway connecting arm having an inner side movably positioned against said second end of said housing;

electrical connecting means arranged in each of said sockets, said electrical connecting means being adapted to mate with a pair of electrical terminals on a corresponding end of said flourescent tube;

a guide tube attached orthogonally to said inner side of said breakaway connecting arm, said guide tube being slidably positioned within a channel on said second end of said housing, wherein said breakaway socket and said breakaway connecting arm are movable longitudinally relative to said housing and guided by said guide tube, said breakaway socket being adapted to be movable away from said fixed socket for releasing said fluorescent tube, so as to enable the removal and replacement of said fluorescent tube, said breakaway socket being adapted to be movable toward said fixed socket for securing said fluorescent tube therebetween; and a threaded stud extending longitudinally from said second end of said housing, a hole arranged on said breakaway connecting arm in alignment with said stud, so that when said breakaway connecting arm is positioned against said second end of said housing, said stud is positioned through said hole, and a nut is threaded onto said stud to secure said breakaway connecting arm to said housing.

* * * * *